United States Patent [19]

Fovargue

[11] 4,185,259

[45] Jan. 22, 1980

[54] MAGNETIC CONTACTOR WITH AN ADJUSTABLE LATCH RELEASE

[75] Inventor: Arthur G. Fovargue, Orchard Park, N.Y.

[73] Assignee: Westinghouse Electric Corp., Pittsburgh, Pa.

[21] Appl. No.: 870,895

[22] Filed: Jan. 19, 1978

[51] Int. Cl.[2] ..... H01H 9/20

[52] U.S. Cl. ..... 335/167; 335/170; 335/176

[58] Field of Search ..... 335/42, 170, 174, 175, 335/176, 167, 168

[56] References Cited

U.S. PATENT DOCUMENTS

| | | | |
|---|---|---|---|
| 1,232,106 | 7/1917 | Shepard | 335/170 |
| 2,125,436 | 8/1938 | Frese | 335/170 |
| 2,549,441 | 4/1951 | Favre | 335/170 |
| 2,669,620 | 2/1954 | McLane et al. | 200/87 |
| 3,511,950 | 5/1970 | Boyd | 200/144 |
| 4,078,219 | 3/1978 | Hodgson | 335/167 |

*Primary Examiner*—Fred L. Braun

*Attorney, Agent, or Firm*—L. P. Johns

[57] ABSTRACT

An electromagnetic contactor characterized by stationary and movable contacts operable between open and closed positions by an armature of an electromagnet which is movable between energized and deenergized positions, and an adjustable latch for latching the armature in the energized position to hold the contacts in the closed position until intentionally released.

6 Claims, 4 Drawing Figures

MAGNETIC CONTACTOR WITH AN ADJUSTABLE LATCH RELEASE

CROSS-REFERENCE TO RELATED APPLICATIONS

This invention is related to that disclosed in the application of Alfred W. Hodgson, Ser. No. 714,219, filed Aug. 13, 1976, now U.S. Pat. No. 4,078,219.

BACKGROUND OF THE INVENTION

1. Field of the Invention

This invention relates to an electromagnetic contactor and, more particularly, it pertains to electromagnetic current off latch therefor.

2. Description of the Prior Art

Generally, a typical magnetic contactor used in industry may from time to time see load currents of from four to ten times the rating of the contactor. If the overload condition persists, an overload relay acts to open the contactor in which case the contactor must interrupt whatever load current is flowing to remove the load from the power system. In many applications, the power system capacity is practically unlimited. Indeed, in some industries, such as marine, railway, mining, offshore drilling, off-road construction, there are a number of applications in which space is at a premium and the machinery builder must resort to unconventional practices to squeeze maximum performance into minimum space. In most of these applications, a power system has limited capacity.

SUMMARY OF THE INVENTION

In accordance with this invention a latch structure is provided for an electromagnetic contactor which comprises stationary and movable contacts, electromagnetic means for moving the movable contacts to the closed position, operative means for moving the movable contact to the open position when the electromagnetic means is deenergized, the electromagnetic means comprising an armature movable between energized and deenergized positions, latch means operative to effect latching of the armature in the energized position to hold the contacts in the closed position after the electromagnetic means is deenergized, the latch means comprising a latch lever and lever-engaging roller-pin being on the armature, and the latch means being unlatchable to effect opening of the contacts by a solenoid which is operatively associated with the latch lever.

The advantage of the device of this invention is that it may be employed to keep contacts in the desired position at normal contact pressure until intentionally disengaged, whereby energy is conserved by deenergizing an electrical hold and contacts are maintained in the desired attitude during shock occasioned by a vibration or otherwise moving the contactor.

DESCRIPTION OF THE PREFERRED EMBODIMENT

Figure 1:
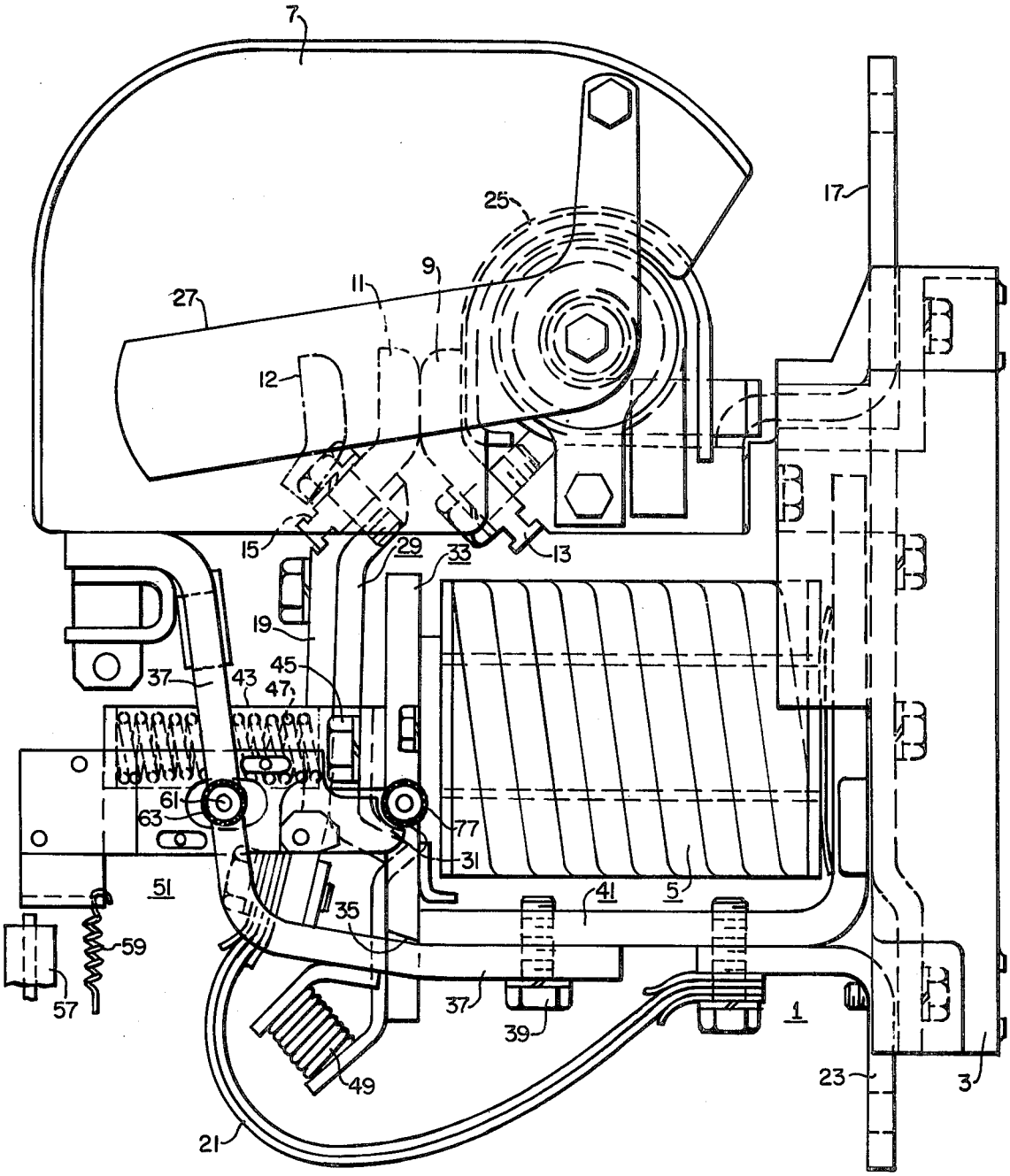
FIG. 1 is a left side view of the contactor.

In FIG. 1 a contactor is generally indicated at 1 and it comprises a base plate 3 of molded electrically insulating material, electromagnetic means or electromagnet 5, and are arc chute 7. In addition, the contactor 1 comprises a stationary contact 9 and a movable contact 11 which are mounted on conductor structures 13 and 15, respectively.

The contactor 1 of this invention is generally disclosed in U.S. Pat. No. 2,669,620 for which reason the description of the contactor 1 is limited herein to the basic structure, operation, and the new and different structures of this invention. Suffice it to say, an electrical circuit through the contactor 1 includes a line connector 17, the conductor structure 13, stationary contact 9, movable contact 11, the conductor structure 15, conductor 19, shunt 21, and a load connector 23. A blowout unit comprising the arc chute 7 includes a blowout coil 25 which is flanked by arcing horns, of which one arcing horn 27 is shown. Both contacts 9, 11 are disposed within the arc chute 7. The blowout coil 25 is electrically series connected between the stationary contact 9 and the line connector 17.

As shown in FIG. 1 the movable contact 11 and the conductor structure 15 are mounted, such as by bolts, to the upper end of the conductor 19. A conductor 29, mounted on the conductor 19, is pivoted at 31.

Associated with the conductor 19 is an electromagnetic structure which comprises the electromagnet 5 and an armature 33. When the electromagnet 5 is energized, the armature is in the position shown in FIG. 1 whereby the contacts 9, 11 are closed. The armature 33 pivots about its lower tapered end 35 which is disposed upon an armature stop bracket 37 the lower end of which is secured, such as by a bolt 39, to a frame and core assembly 41. A stirrup which is mounted upon the armature, such as by bolts 45, is equipped with a contact spring 47, the lower end of which presses against the conductor 19 and forces the contacts 9, 11 together.

Conversely, when the electromagnet 5 is deenergized the armature 33, under the influence of a kickout spring assembly 49, rotates counterclockwise about the point 35 together with the conductor 19 toward the stop bracket 37, whereupon the movable contact 11 moves to the open (broken line) position 12.

Figure 3:
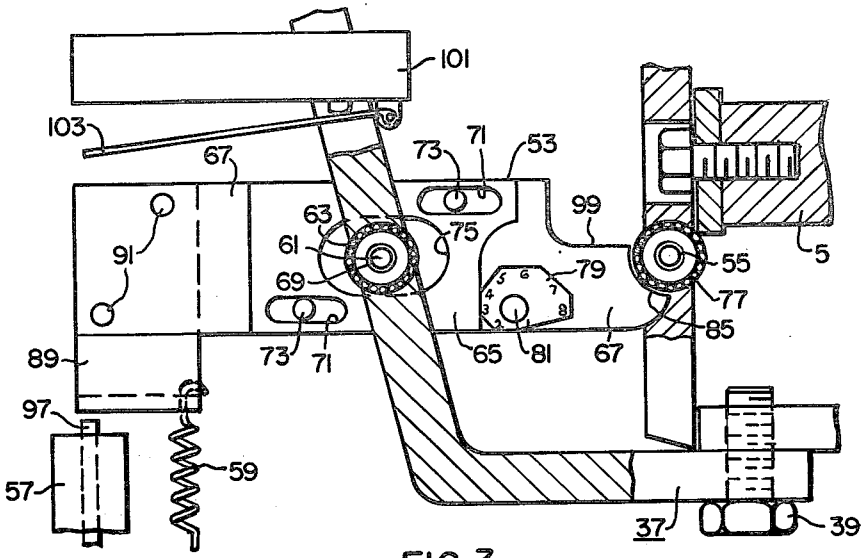
FIG. 3 is a fragmentary sectional view of the contactor in a latched position.
Figure 4:
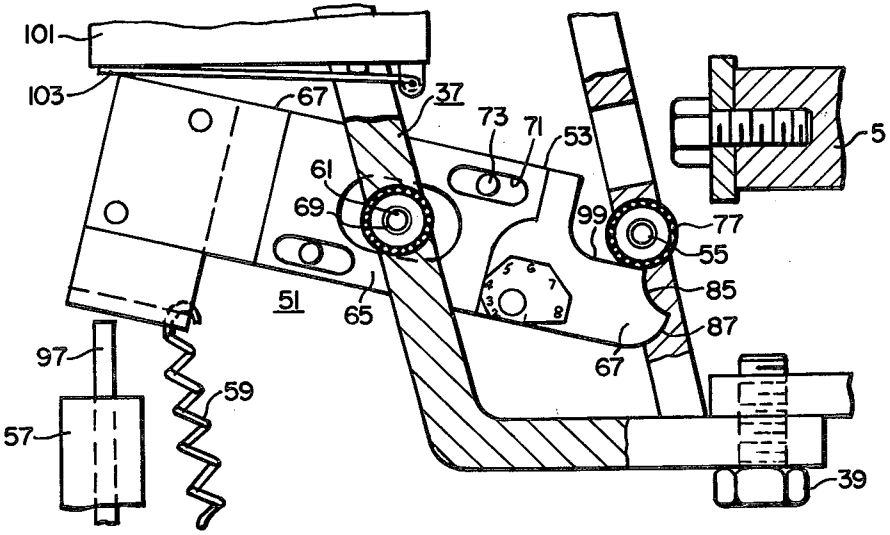
FIG. 4 is a fragmentary sectional view of the contactor in the unlatched position.

In accordance with this invention the contactor 1 is provided with a latch structure, generally indicated at 51. As shown more particularly in FIGS. 3 and 4 the latch structure 51 comprises a latch lever 53, a latch pin 55, and electromagnetic means, such as a solenoid 57, for unlatching the armature 33. As shown in FIG. 3, biasing means, such as a latching spring 59, normally retain the latch lever 53 in the latched position.

In FIG. 3 a pivot pin 61 extends from one side of the armature stop bracket 37 and is provided with a pivot bearing 63. The latch means is rotatably mounted on the bearing 63 and comprises a pivot plate 65 and a latch lever 67. The pivot plate 65 includes an aperture 69 which is rotatably mounted on the pivot pin 61. In addition, the pivot plate 65 comprises aperture means, such as a pair of similar slots 71, which extend in a direction substantially parallel to the longitudinal axis of the latch lever 67.

The latch lever 67 is adjustably mounted on the pivot plate 65 by clamping means, such as similar bolts 73, which separately extend through corresponding slots 71. In addition, the latch lever 67 comprises an elongated slot 75 which is substantially parallel to the longitudinal axis of the latch arm 67. The slot 75 clears the assembly of the pivot pin 61 and pivot bearing 63, so that the latch arm may be adjustably moved toward or away from the latch pin 55 and a latch bearing 77 on the pin.

Adjustment of the latch arm 67 with respect to the latch bearing 77 is accomplished by moving the arm to the right or left of the pivot pin 61, as viewed in FIG. 3, which movement is permitted by the slots 71 and 75. When the correct adjustment is obtained, the bolts 73 are tightened in place which clamp the latch arm against the pivot plate 65.

The desired position of the arm 67 with respect to the bearing 77 may be fixed by locating a blocking washer on the arm 67. The blocking washer 79 is rotatably mounted on the arm by a screw 81. The washer, being eccentric with a plurality (such as eight) of sides at different spacings from the screw 81, is rotated to the desired position so that one of the sides of the washer is located for abutment with an end surface 83 of the pivot plate 65. The bolts 73 are then tightened in place.

The primary purpose for adjusting the latch arm 67 on the pivot plate 65 is to compensate for construction tolerances of the contactor 1. The assembly of the pivot plate 65 and the latch arm 67 together with the eccentric washer 79 enables the latch arm to be moved to the proper adjustment position and provide the correct tension and pressure between the armature 33 and the needle bearing 77.

Figure 2:
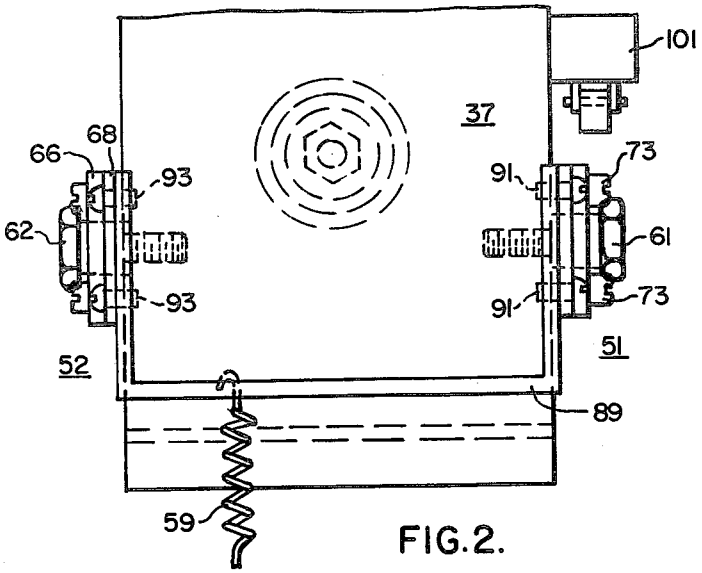
FIG. 2 is a front view of the contactor.

More particularly, the latch arm 67 comprises the notched end surface 85 having a radius corresponding to that of the bearing 77. Accordingly, an end portion 87 of the latch arm 67 is disposed below the bearing and/or latch pin 55 to provide a latched condition between the latch arm and the armature 33, when the armature is in the energized position as shown in FIG. 3. At the end of the latch arm 67 remote from the armature 33, a coupling 89 is provided to interconnect the latch structure 51 with a similar latch structure 52 (FIG. 2) on the other side of the contactor. The latch structure 52 corresponds to latch structure 51 and comprises a similar pivot pin 62, a pivot plate 66, and a latch arm 68. The coupling 89 is a U-shaped member having one leg portion secured to the latch structure 51 by similar bolt screws 91 and having another leg portion secured to the latch structure 52 by similar screws 93. The latching spring 59 is secured to the coupling 89.

When it is necessary to maintain the armature 33 in the latched position, the latch structures 51, 52 maintain the armature 33 in that position even though the electromagnet 5 is deenergized, thereby maintaining the contacts 9, 11 in the closed position. Release of the armature 33 from the latched position is accomplished by momentarily energizing the delatching solenoid 57, whereby a solenoid armature 97 strikes the coupling 89 to rotate it clockwise around the pivot pins 61, 62. Thus, the notched end surface 85 is dislodged from contact with the bearing 77 and the armature 33 moves to the unlatched position (FIG. 4) as the bearing 77 rolls out of the notched end surface 85 and onto a surface 99 of the clearance notch on the upper side of the latch arm 67. Accordingly, the contacts 9, 11 are moved to the open positions.

Moreover, an auxiliary switch 101 having an actuating arm 103 may be provided, such as by being mounted on the armature stop bracket 37, to provide an electrical interlock or other indication of the position of the latch structure 51. The delatching motion of the latch arm 67 moves the switch arm 103 (FIG. 4) to actuate or deactuate the switch 101, depending upon the particular indication provided by the switch.

Finally, when the electromagnet 5 is reenergized, the armature 33 returns to the position of FIG. 3. However, the latch structure 51 is maintained in the delatched position (FIG. 4) until the solenoid 57 is deenergized to permit the latching spring 59 to rotate the latching structure counterclockwise from the position of FIG. 4 to that of FIG. 3.

What is claimed is:

1. An electromagnetic contactor comprising stationary and movable contacts, electromagnetic means for moving the movable contact to the closed position, operative means for moving the movable contact to the open position when the electromagnetic means is deenergized, the electromagnetic means comprising an electromagnet and an armature structure movable between energized and deenergized positions, a stop bracket on the side of the armature structure opposite the electromagnetic means, latch means for latching the armature structure in the energized position to hold the contacts in the closed position after the electromagnetic means is deenergized, the latch means comprising a latch lever pivotally mounted on the bracket, and movable between latched and unlatched positions of the armature structure, the latch lever being engageable with the armature structure for holding said structure in the latched position, bias means for biasing the latch lever in the latched position, delatching means for moving the latch lever to the unlatched position and comprising a latching electromagnet, pivot means for pivotally mounting the latch lever and comprising a pivot pin on the bracket, the latch lever comprises a pivot plate and a latch arm, the pivot plate being rotatably mounted on the pivot pin, and the latch arm being adjustably mounted on the pivot plate.

2. The contactor of claim 1 in which the latch arm comprises an end surface abuttable with the armature structure, and the latch lever includes adjustable means for altering the distance between the pivot pin and the end surface.

3. The contactor of claim 2 in which the latch arm is slidably mounted on the pivot plate between the pivot pin and the armature means, and in which the adjustable means comprises releasable means for holding said arm and said plate fixedly together.

4. The contactor of claim 3 in which a blocking washer means is adjustably mounted on the latch arm for abutment with the pivot plate during slidable adjustment of the arm on the plate, and in which the washer means comprises peripheral edges having varying distances from the pivot pin for varying adjustments of the arm.

5. The contactor of claim 4 in which the armature structure comprises an armature and a latch pin, and in which the end surface of the latch arm abuts the latch pin when the armature is in the energized position.

6. The contactor of claim 5 in which the latch pin is a lever-engaging roller-pin, and in which said end surface comprises a contour fitting that of the roller-pin.

* * * * *